United States Patent [19]

Clayton

[11] Patent Number: 4,757,676

[45] Date of Patent: Jul. 19, 1988

[54] PNEUMATIC SPLICER WITH THREAD TWISTING MEANS

[75] Inventor: James W. B. Clayton, Gwent, Wales

[73] Assignee: Pentwyn Precision Limited, Great Britain

[21] Appl. No.: 65,343

[22] Filed: Jun. 23, 1987

[30] Foreign Application Priority Data

Jun. 26, 1986 [GB] United Kingdom ..... 8615636

[51] Int. Cl.[4] ..... D01H 15/00

[52] U.S. Cl. ..... 57/22; 57/261

[58] Field of Search ..... 57/22, 23, 261

[56] References Cited

U.S. PATENT DOCUMENTS

| | | | |
|---|---|---|---|
| 4,407,117 | 10/1983 | Garnsworthy | 57/22 |
| 4,445,317 | 5/1984 | Mima | 57/22 |
| 4,445,318 | 5/1984 | Becker et al. | 57/22 |
| 4,494,367 | 1/1985 | Badiali | 57/22 |
| 4,499,715 | 2/1985 | Chardon et al. | 57/22 |
| 4,539,802 | 9/1985 | Bertoli et al. | 57/22 |
| 4,545,191 | 10/1985 | Bertoli et al. | 57/22 |
| 4,570,427 | 2/1986 | Premi et al. | 57/22 |

*Primary Examiner*—Donald Watkins

*Attorney, Agent, or Firm*—Allegretti, Newitt, Witcoff & McAndrews, Ltd.

[57] ABSTRACT

A yarn splicer having a closable pneumatic chamber which is permanently open at each end so as to receive the yarns to be spliced from opposite ends, discrete yarn rolling means arranged on either side of the splicer adjacent each end of the chamber to engage the running portion of a respective yarn in the chamber, and yarn gripping means also disposed at either end of the chamber to engage the respective loose ends of the yarns. Actuation of the splicer results in a prescribed rolling action on the yarns in a direction to completely detwist them, and deactivation results in an equal and opposite action on the yarns so as to restore the original twist.

The preferred arrangement has a biased lost motion linkage between the actuation means and the chamber-mechanism which provides a drive to the rolling means and gives an over-twist to the yarns during detwisting and which recovers the over-twist as well as restoring the original twist at the termination of the splice.

13 Claims, 5 Drawing Sheets

PNEUMATIC SPLICER WITH THREAD TWISTING MEANS

RELATED APPLICATION

This application is related to U.S. Ser. No. 806,273 filed on the Dec. 6, 1985 by James William Barnes Clayton and David Thomas Arthur Fuller, the disclosure of which is hereby incorporated into this specification.

BACKGROUND OF THE INVENTION

This invention concerns detwisting means for a thread splicer and is a modification of a previous invention disclosed in the said copending U.S. patent application No. 806,273. In particular it represents an alternative design to that of the embodiment of the aforesaid invention disclosed with reference to FIGS. 5 and 6 of that application. In the said embodiment of the previous invention thread or yarn detwisting is carried out on each side of the splicing chamber by pairs of opposed contra-displacing linear members in between which the threads on each side are trapped. The movement required of the linear members is considerable, especially with high-twist multi-ply yarns, and the housing of these members greatly increases the physical dimensions of the splicer. In addition, somewhat complicated pneumatic connections and drives are required to displace the linear members.

SUMMARY OF THE INVENTION

In the present invention detwisting is provided by respective pairs of contra-rotating friction plates provided on each side of the pneumatic splicing chamber. The plates of each pair which mutually engage the respective thread or yarn rotate about axes which are substantially normal to a vertical plane longitudinally bisecting the splicing chamber. On both sides the operation is such as to detwist the yarns or threads before the splice and to restore the twist to the spliced yarns after splicing.

In the preferred embodiment a thread guide and air baffle plate is fitted behind the splicing chamber. Respective slots in this plate guide the threads or yarn ends where they leave the splicing chamber. Each slot extends from a respective end of the plate towards the chamber along a line which is slightly offset in the lateral plane from the longitudinal axis of the chamber, the respective offsets being in opposite directions so that the threads leave the chamber at small angles to the said axis. The offset direction is dependent upon the direction of twist of the thread, so that when the type of thread changes so as to have a different direction of twist, the plate will be replaced or turned upside down. Also in the preferred embodiment an additional twist, i.e. an over twist, is imparted to the threads or yarns during splicing and a corresponding additional retwisting is provided in the thread or yarn after splicing. By said means any tendency of the cut ends of the separate threads (or yarns) to lift from the splice during the processing of the spliced thread before weaving is discouraged.

The contra-rotating friction plates of the inventive concept are preferably coupled on each side to respective pulleys and are belt driven from a drive pulley coupled to a rack and pinion drive, the rack being in the form of a sector which is attached to the manual splicing actuator. On each side two belts, appropriately quarter-twisted in counter directions, engage the respective common drive pulley, and are guided by an intermediate idler roller. This arrangement ensures that the respective friction plates rotate equally in opposite directions and in unison without the use of pneumatic drives or complicated gearing to the friction plates

BRIEF DESCRIPTION OF THE DRAWINGS

Hereinafter the invention is further described by way of example and with reference to the accompanying drawings, wherein.

DESCRIPTION OF PREFERRED EMBODIMENT

Figure 1:
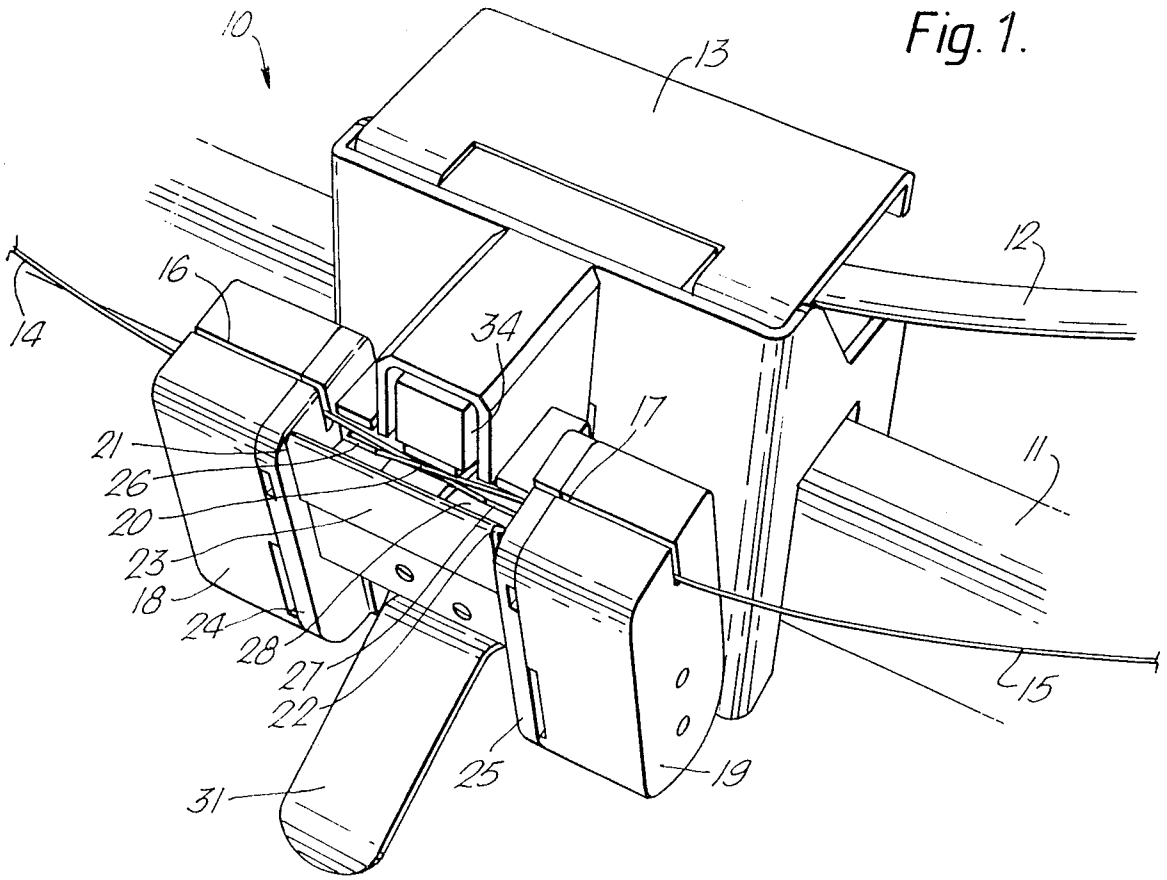
FIG. 1 is a perspective view of the preferred embodiment of the pneumatic splicer of the invention, with threads arranged for splicing in the splicing chamber and the latter in the loading position.
Figure 2:
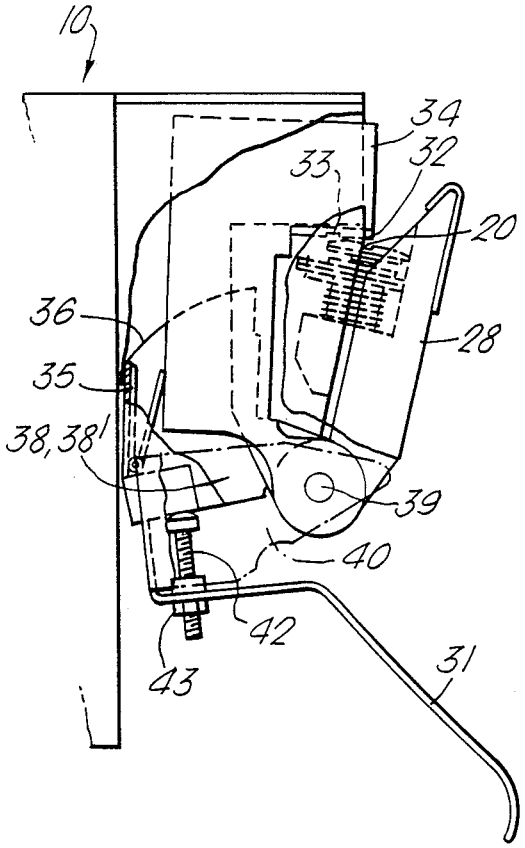
FIG. 2 is a sectional end elevation of a portion of the pneumatic splicer showing the splicing chamber in the loading position and the actuating linkage therefor.

The pneumatic splicer herein described is distinguished from the splicer described in our said copending application No. 806273 by the different thread guides and by different thread detwisting arrangements and also in respect of features which are not related to the present invention. The pneumatic chamber per se does not form part of the present invention. Therefore the said features, the pneumatic chamber and the pneumatic actuating mechanism therefor are outlined hereafter in general and not in particular. The reader is referred to the aforementioned prior U.K. and European applications for further particulars of the splicer and its splicing head.

As shown, the splicer 10 is adapted for mounting on a structural part 11 of the associated mule, thereby leaving both the operator's hands free for threading the splicer and attending to his general duties. A supply of high pressure air is required for the splicing operation and a connection (not shown) for an air hose 12 is provided beneath the cover 13. The threads 14, 15 to be joined are laid one from each direction on the left and the right in the slots 16, 17 in the side covers 18, 19 and also in the open slot 20 in the fixed portion of the splicing chamber. The free ends of the threads are taken through narrow gaps or passages 21, 22, formed at the sides of the hinged front plate 23, which mounts the fixed part of the splicing chamber, and between this plate and the side plates 24, 25, and are then pulled down through the respective slots 26, 27 in a thread guide and baffle plate 28 (best seen in FIG. 3). A respective pair of scissors 29, 30 operated manually by means of the manual actuator 31, is mounted immediately behind each respective slot 26, 27 in the plate 28. Though not visible in the drawings, the slots 26, 27 are offset from the longitudinal axis of the plate 28 in opposite directions by small amounts. Therefore the thread ends are disposed at small angles to the axis of the chamber where they pass from the latter to the said slots. The direction of the offset is dependent upon whether the threads being spliced have "S" twists or "Z" twists. Therefore when the threads change in this respect the plate must be removed, turned-over and be replaced so that the offsets are disposed in the opposite directions to what they were before the change.

A pneumatic piston 32 having a complementary splicing chamber slot 33 is housed in a movable portion 34 of the splicing chamber which is mounted in the splicer housing on a pivot 39. This movable portion is pulled towards an abutment at the rear of the splicer by means of a spring in the housing (not shown) which is connected between the said movable portion 34 of the splicing chamber at the housing wall. A further spring 35 is situated between said movable portion 34 of the splicing chamber and a bracket 36 which mounts a pneumatic valve 37 and has a pair of parallel arms 38, 38' which extend on each side of the said movable portion 34 of the splicing chamber to the pivot 39 on which they are mounted. Spring 35 maintains bracket 36 and movable portion 34 angularly separated and provides a lost motion linkage. The manual actuator 31 is also mounted on extensions of the pivot 39 by means of a pair of parallel arms 40, 40' which embrace the side plates 24, 25 and it has an adjustable abutment in the form of a screw 42 which at one end engages a thread in a boss 43 on the actuator 31 and at the other end engages an actuator of the pneumatic valve 37. Screw 42 provides adjustment of the lost motion between the manual actuator 31 and the movable portion 34 of the splicing chamber.

Depression of the manual actuator 31 results, inter alia, in the said movable portion 34 of the splicing chamber pivoting out of the splicer 10 about the pivot 39 until the two slots 20, 33 are in conjunction, at which position the said movable portion abuts a stop. Pressure on the pneumatic actuator of valve 37 by the screw 42 causes air to be bled into the housing at the rear of the piston 32, forcing the latter into contact with the fixed portion of the splicing chamber, and finally, when the said slots of the chamber are in conjunction, causing high pressure air to be vented into the chamber through a small orifice in the piston (not shown). By virtue of the lost motion linkage, further pressure on the manual actuator 31 results in further rotational movement of the latter to absorb the lost motion between the bracket 36 and the movable portion 34 of the splicing chamber against the bias of the spring 35. Operation of the scissors occurs during the final movement of the movable portion of the splicing chamber to the splicing position.

The manual actuator 31 is biased to its initial, rest, position by a pair of springs 44, 44' (see FIG. 3) each of which is attached at one end to the respective side plate 24, 25 and at its other end to an over-centre portion of the respective arm 40 (40') of the actuator 31.

Figure 3:
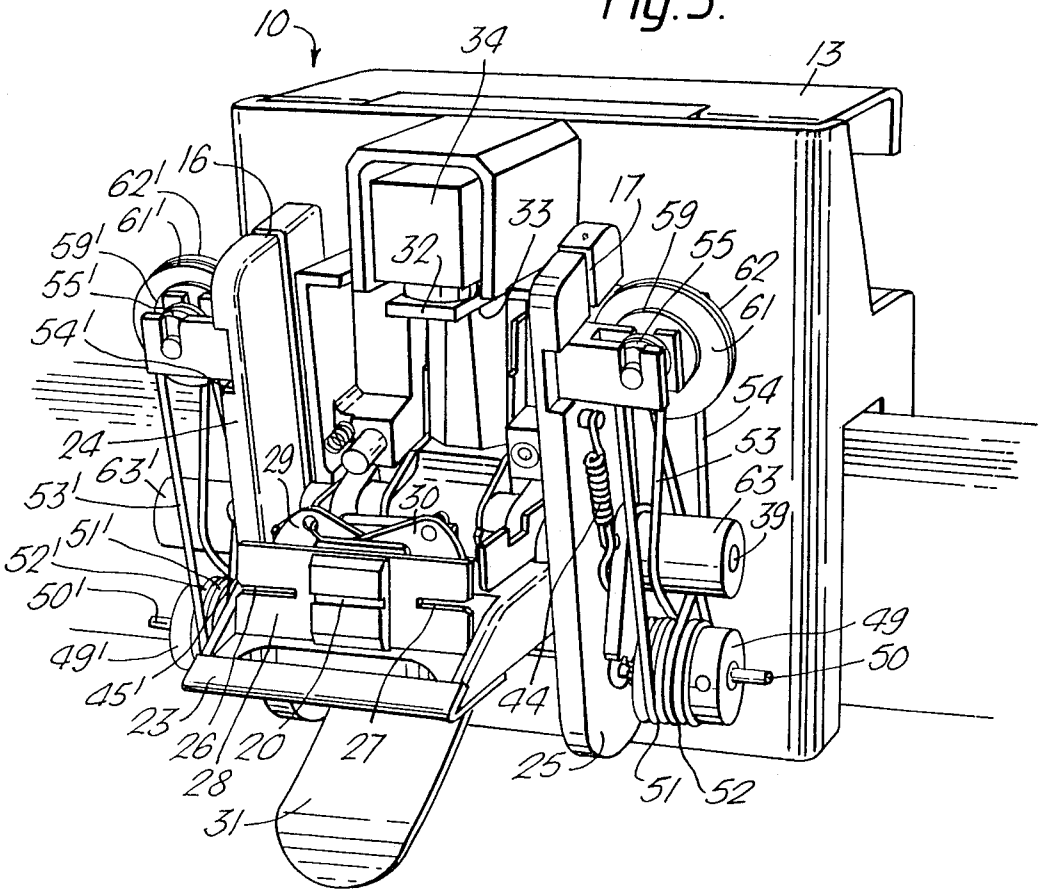
FIG. 3 is a perspective view of the pneumatic splicer comparable to that of FIG. 1 but with the splicing head opened and with the side covers removed.
Figure 4:
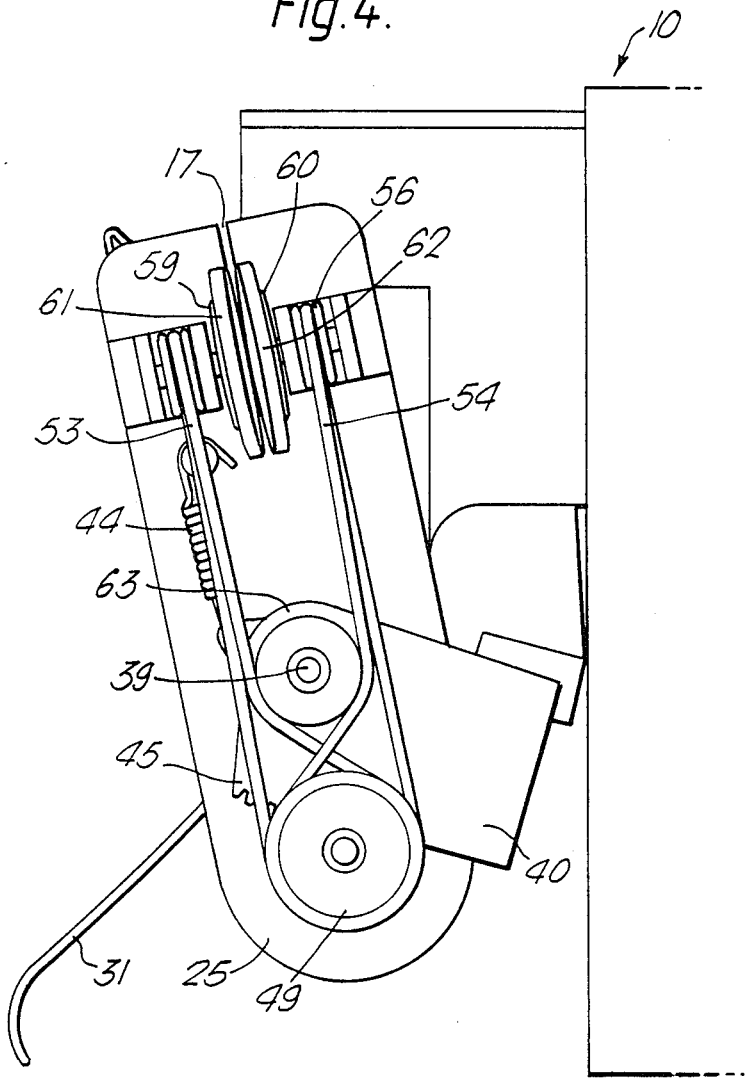
FIG. 4 is a side elevation of a portion of the pneumatic splicer with the respective side cover removed to show the friction plates and drive arrangements.
Figure 5:
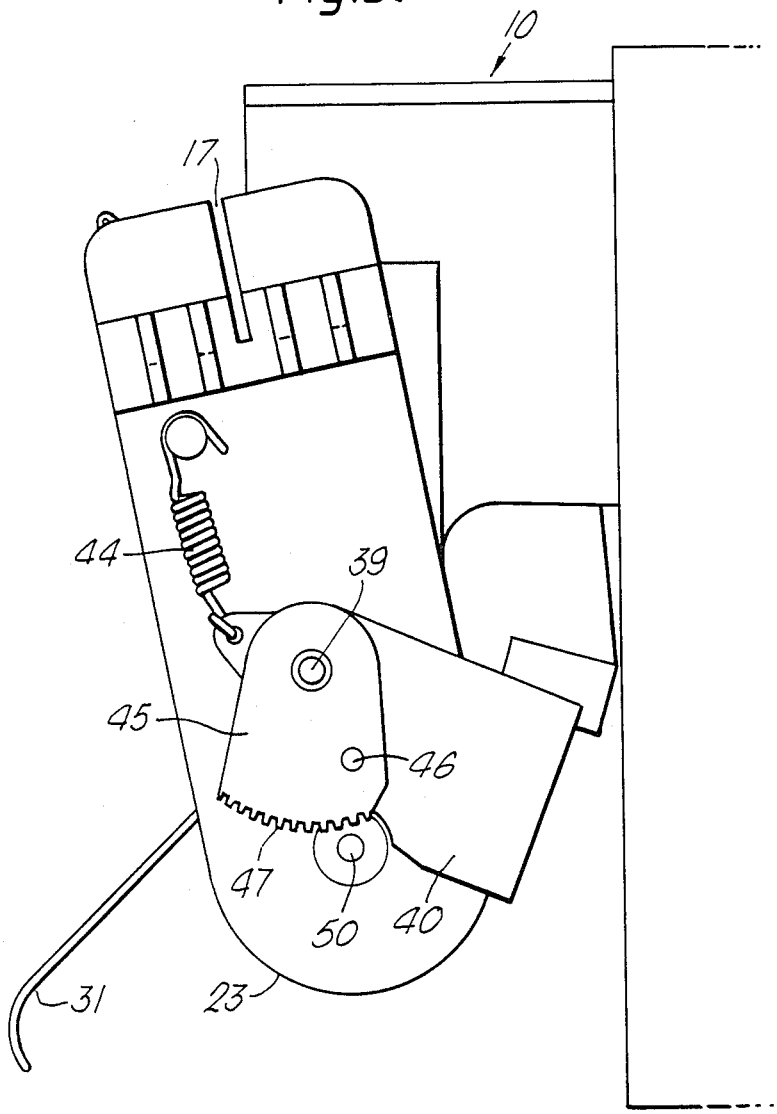
FIG. 5 is a similar view to that of FIG. 4 but with the drive plates, pulleys and belts removed so as to show ths sector rack.

Referring now particularly to FIGS. 3–5, wherein the splicer is shown without its side covers 18, 19, on each of the arms 40 (40') of the manual actuator 31 there is mounted a sector 45 (45') which has the same axis of rotation as the manual actuator, being journalled on the same pivot 39 and is constrained to move with the respective arm by a peg 46 (46') spaced apart from said pivot. Rack 47 (47') which is situated at the lower end of the sector 45 (45') meshes on each side with a pinion 48 (48') formed on the inside of a respective pulley 49 (49') mounted for rotation on a stub axle 50 (50') extending from the respective side plate 25 (24). Pulley 49 (49') has a pair of side-by-side circumferential grooves 51, 52 (51', 52') which receive respective circular cross-section belts 53, 54 (53', 54') which may be rubber "O" rings. These belts engage on each side of the splicer a respective pair of pulleys 55, 56 (55', 56'), disposed just below the horizontal plane of the splicing chamber, which are of smaller diameter than the lower pulley 49 (49'). Small pulleys 55, 56 (55', 56') rotate on axles 57, 58 (57', 58') which slope slightly downwards and outwards towards each other so as to subtend towards each other.

A compound angle of 3° but which are mutually substantially normal to the vertical plane longitudinally bisecting the chamber. Consequently, the tensions of the belts cause reaction forces acting on the pulleys so as to bias them towards one another during each splicing operation. Each small pulley axle has a plate 59, 60 (59', 60') mounted at its inside end on which there is a smaller diameter boss facing away from the respective small pulley and on each boss there is mounted a stiff rubber washer (or washer of similar inherently resilient frictional material) 61, 62 (61', 62'), each washer being a friction fit on its respective boss. Because of the inclination of the axes of the pulleys the respective pairs of washers provide a face-engagement nip at the top edges thereof nearest to the splicing chamber. An idling roller 63 (63') is mounted for rotation on each side on a shaft forming an extension of the pivot 39. The belts 53, 54 (53', 54') are respectively taken one side and the other of the respective roller. Consequently one run of each belt from opposite sides of the large pulley 49 (49') is in contact with the roller. The belts are quarter-twisted in opposite directions so that when the manual actuator is depressed the small pulleys of each pair rotate in opposite directions, causing the respective washers to likewise rotate oppositely and in such directions as to untwist a thread trapped between them.

The detwisting and retwisting operation is as follows. When yarns or threads, of appropriate twist, are threaded through the splicing chamber and the slots 16, 17, they are automatically engaged by the nip of the respective washers 61, 62 (61', 62') which are sprung apart to admit the respective yarn or thread. Upon depressing the manual actuator the sector racks 47, 47' swing through the major part of their operating arcs as the movable portion 34 of the splicing chamber displaces to its operating position. The meshing pinions 48, 48' are rotated during the movement and as a consequence the drive pulleys 49, 49' are likewise rotated. The displacement is translated, though the action of the belts 53, 54 and 53', 54' engaging with the pulleys 49, 55, 56, 49', 55', 56', to the washers 61, 62 and 61', 62' with velocity ratios corresponding to the ratios of the diameters of the large and small pulleys, said ratios being sufficient in magnitude to provide just the appropriate amount of detwist to totally unravel the yarns or threads. At this point the two slots 20, 33 of the pneumatic chamber are in conjunction and air is blasted therein. Further pressure on the manual actuator results in the lost motion of the linkages being recovered and an "over-twisting" of the filaments of the yarns or threads due to a further swing of the sector racks, which action in some way not altogether clear (but nonetheless demonstrable) locks the filaments together more securely during the splice. When the manual actuator is released the yarns or threads are retwisted and the "over-twist" is recovered. The result is a secure, tidy, splice between the two threads in which the tendency of the cut ends of the filaments to lift during subsequent processing of the thread prior to weaving is substantially reduced.

The apparatus is rendered suitable equally for "S" twist and "Z" twist yarns or threads by suitably mounting the belts 53, 54, 53', 54' on their respective pulleys 49, 55, 56, 49', 55', 56'.

I claim:

1. A yarn or thread splicer having a pneumatic splicing chamber through which the yarns to be joined pass in opposite directions, characterised in that it comprises discrete yarn rolling means disposed adjacent each end of the chamber, each said means for operating on the running end of a respective one of the said yarns, and respective yarn gripping means corresponding to each said yarn rolling means disposed adjacent the respective opposite end of the chamber for gripping the free or broken end of each yarn, said yarn rolling means each engaging a respective yarn and twisting it in a direction to cause unravelling of its strands at the commencement of the splicing operation and retwisting the respective yarn in the opposite direction to cause the normal twist to be restored to the yarn during the termination of the splicing operation.

2. A yarn or thread splicer according to claim 1 wherein said yarn rolling means comprises a pair of operably contra-rotating bodies having substantially common axes of rotation adjacent each end of the splicing chamber, which bodies present generally conical axial end faces to one another between which faces the running end of one of the yarns to be joined is engaged so as to rotate the yarn to detwist it at the commencement of the splicing operation and to rotate the yarn in the opposite direction during the termination of the splicing operation so as to retwist it.

3. A yarn or thread splicer according to claim 2 wherein one of said contra-rotating bodies has an internally facing conical surface and the other has a matching externally-facing conical surface.

4. A yarn or thread splicer according to claim 2 wherein said pairs of contra-rotating bodies have a common rotational axis along which they are coupled so as to provide relative equal and opposite twisting motion on the two yarns to be joined, said twisting motion being manually applied.

5. A yarn or thread splicer according to claim 2 wherein said contra-rotating bodies comprise opposed friction plates which mutually engage the respective yarn between their axial-end faces so as to detwist and retwist the yarn.

6. A yarn or thread splicer according to claim 5 wherein said plates comprise thin discs mounted on respective axes which are slightly and symmetrically angled relative to a perpendicular to a medial plans of the splicing chamber, said discs being flexible and having facing surfaces which are in contact so as to have portions of these surfaces which are adjacent and parallel along corresponding radii.

7. A yarn or thread splicer according to claim 6 wherein said axes are angled at 5° to said perpendicular in orthogonal planes one of which includes the longitudinal axis of the splicing chamber.

8. A yarn or thread splicer according to claim 6 wherein each said disc is mounted coaxially with and to a respective pulley which is journalled in the casing of the splicer so as to have freedom of rotational movement and freedom of axial movement within limits, there being a belt drive means for transmitting a drive to the said disc pulley from a drive pulley common to each disc which is rotationally mounted on said casing in said medial plane, said drive being transmitted along a line which subtends an angle less than 90° to the axis of the disc pulley whereby during operation of the splicer the said disc pulley and the said disc attached thereto are biased towards the opposing disc pulley and disc.

9. A yarn or thread splicer according to claim 8 wherein said belt drive means comprises, on either side of the casing, a single endless resilient band which provides drive to each disc pulley of the respective pair.

10. A yarn or thread splicer according to claim 9 wherein said common drive pulley has gear teeth around its periphery which engage with a rack attached to a manual operator.

11. A pneumatic splicer according to claim 2 further comprising a plate disposed so as to extend away from each end of the chamber, each said plate having a slot extending partly through the length of the plate from its edge furthest from the chamber in a direction towards the chamber, each slot being parallel to but being spaced from the longitudinal axis of the chamber, said slots being equally spaced from said axis in opposite directions so as to provide means for gripping the free ends of the yarns.

12. A pneumatic splicer according to claim 11 wherein said plate is disposed to function as an air baffling means.

13. A pneumatic splicer according to claim 2 having an actuating mechanism including an operator, a pneumatic valve and a valve actuator therefor characterised in that said mechanism embodies a biased lost motion linkage coupled to the splicing chamber and the yarn rolling means, which, during operation, provides overtravel of the operator and further operation of the yarn rolling means after the splicing chamber has been set for splicing, thereby adding additional detwisting and retwisting to the yarns during and after the splicing operation.

* * * * *